US011073052B2

(12) United States Patent
Mehring

(10) Patent No.: US 11,073,052 B2
(45) Date of Patent: Jul. 27, 2021

(54) VALVETRAIN FOR AN INTERNAL COMBUSTION ENGINE, IN PARTICULAR OF A MOTOR VEHICLE

(71) Applicant: Daimler AG, Stuttgart (DE)

(72) Inventor: Martin Mehring, Weinstadt (DE)

(73) Assignee: Daimler AG, Stuttgart (DE)

( * ) Notice: Subject to any disclaimer, the term of this patent is extended or adjusted under 35 U.S.C. 154(b) by 0 days.

(21) Appl. No.: 16/955,226

(22) PCT Filed: Dec. 17, 2018

(86) PCT No.: PCT/EP2018/085265
§ 371 (c)(1),
(2) Date: Jun. 18, 2020

(87) PCT Pub. No.: WO2019/121546
PCT Pub. Date: Jun. 27, 2019

(65) Prior Publication Data

US 2020/0325804 A1 Oct. 15, 2020

(30) Foreign Application Priority Data

Dec. 21, 2017 (DE) ..... 10 2017 011 855.8

(51) Int. Cl.
*F01L 13/06* (2006.01)
*F01L 1/047* (2006.01)
(Continued)

(52) U.S. Cl.
CPC ..... *F01L 13/06* (2013.01); *F01L 1/047* (2013.01); *F01L 33/00* (2013.01); *F01L 2013/10* (2013.01)

(58) Field of Classification Search
CPC . F01L 13/06; F01L 1/047; F01L 33/00; F01L 2013/10; F01L 1/053; F01L 2013/101; F01L 13/0036; F01L 2001/0473
See application file for complete search history.

(56) References Cited

U.S. PATENT DOCUMENTS 5,289,806 A * 3/1994 Hurr ..... F01L 13/0036 123/90.17
8,746,195 B2 * 6/2014 Werler ..... F01L 13/0042 123/90.18
8,893,674 B2 * 11/2014 Lengfeld ..... F01L 1/053 123/90.16

(Continued)

FOREIGN PATENT DOCUMENTS

DE 10 2013 019 000 A1 5/2015
JP 62-184118 U 11/1987

OTHER PUBLICATIONS

PCT/EP2018/085265, International Search Report dated Mar. 15, 2019 (Two (2) Pages).

*Primary Examiner* — Hung Q Nguyen
(74) *Attorney, Agent, or Firm* — Crowell & Moring LLP

(57) ABSTRACT

A valvetrain for an internal combustion engine has a camshaft rotatable about an axis of rotation, a sliding-block element connected in a rotationally fixed manner to the camshaft and displaceable in the axial direction of the camshaft relative thereto, which sliding-block element has an outer circumferential jacket surface with a shift gate via which a rotational movement of the sliding-block element can be converted into a displacement of the sliding-block element in the axial direction of the camshaft relative thereto, and a shift rod at least partially accommodated in the camshaft and displaceable by the sliding-block element in the axial direction of the camshaft relative thereto and via which shift rod an actuation of a gas exchange valve can be influenced.

10 Claims, 7 Drawing Sheets

(51) Int. Cl.
*F01L 33/00* (2006.01)
*F01L 13/00* (2006.01)

(56) References Cited

U.S. PATENT DOCUMENTS

| | | | | |
|---|---|---|---|---|
| 2012/0138001 | A1 | 6/2012 | Werler et al. | |
| 2013/0104824 | A1 | 5/2013 | Weinmeister | |
| 2016/0298508 | A1* | 10/2016 | Lahr | F01L 13/06 |
| 2017/0276027 | A1* | 9/2017 | Altherr | F01L 1/053 |
| 2017/0362969 | A1* | 12/2017 | Altherr | F01L 13/0036 |
| 2018/0230862 | A1* | 8/2018 | Altherr | F01L 13/0036 |

* cited by examiner

VALVETRAIN FOR AN INTERNAL COMBUSTION ENGINE, IN PARTICULAR OF A MOTOR VEHICLE

BACKGROUND AND SUMMARY OF THE INVENTION

The invention relates to a valvetrain for an internal combustion engine, in particular of a motor vehicle.

Such a valvetrain for an internal combustion engine, in particular of a motor vehicle, for instance of a car, is for example already known from DE 10 2013 019 000 A1. The valvetrain has at least one camshaft rotatable about an axis of rotation and also at least one sliding-block element which is connected in a rotationally fixed manner to the camshaft and is displaceable in the axial direction of the camshaft relative to the camshaft. In this case, the sliding-block element has an outer circumferential jacket surface with at least one shift gate, by means of which a rotational movement of the sliding-block element can be converted into a displacement of the sliding-block element in the axial direction of the camshaft relative to the camshaft. To this end, for example, at least one partial region or length region of the shift gate extends in a plane extending obliquely to the axis of rotation, about which the camshaft and hence the sliding-block element are rotatable. In particular, at least one wall region that at least partially delimits the shift gate in the axial direction of the camshaft extends in the plane extending obliquely to the axis of rotation, or at least one plane tangential to the wall region extends obliquely to the axis of rotation. To this end, for example, at least the abovementioned partial region or length region is configured to be arcuate.

In DE 10 2013 019 000 A1, for example, a pin is moved into the shift gate in the radial direction of the camshaft, such that the pin engages in the shift gate. If the camshaft and hence the sliding-block element are rotated about the axis of rotation relative to the pin, and the pin then comes to a position supported against the wall region, the rotation of the sliding-block element about the axis of rotation is converted into a translational movement and hence into a displacement of the sliding-block element along the axis of rotation, with the sliding-block element being displaced in the axial direction of the camshaft relative thereto.

The valvetrain further has a shift rod at least partially accommodated in the camshaft and displaceable by means of the sliding-block element in the axial direction of the camshaft relative to the camshaft, by means of which shift rod an actuation of at least one gas exchange valve can be influenced. The shift rod is displaceable over the sliding-block element in the axial direction of the camshaft relative thereto, by the sliding-block element being displaced in the axial direction of the camshaft relative thereto. In this case, for example, the shift rod is connected to the sliding-block element, such that the shift rod is displaceable with the sliding-block element in the axial direction of the camshaft relative to the camshaft. For example, by displacing the shift rod between an engine braking mode and a firing mode, the internal combustion engine can be switched over, for example by means of the shift rod being able to be switched over between an actuation of at least one gas exchange valve effected by a first cam and an actuation of the gas exchange valve effected by a second cam different from the first cam. In this case, the first cam is for example a firing cam, with the second cam being for example what is referred to as a braking cam. If, for example, the gas exchange valve is actuated by means of the firing cam, the firing mode of the internal combustion engine is set as a result. If, for example, the gas exchange valve is actuated by means of the braking cam, the engine braking mode is set as a result. The camshaft itself could optionally be adjusted by means of the shift rod.

The object of the present invention is to develop a valvetrain of the type mentioned at the outset, that enables particularly advantageous influencing of the gas exchange valve to be achieved.

In order to refine a valvetrain of the type mentioned herein that enables particularly advantageous influencing of the actuation of the gas exchange valve to be achieved, at least one bushing is provided according to the invention, wherein at least one length region of the sliding-block element rotatable about the axis of rotation relative to the at least one bushing is accommodated in the at least one bushing. Furthermore, the at least one bushing is displaceable in the axial direction of the camshaft relative thereto.

According to the invention, moreover, at least one form-fitting element is provided on the at least one bushing, wherein the form-fitting element engages in a slide region of the shift gate which is at least partially arranged in the length region. In addition, at least one fixing device is provided, which can be switched over between at least one enabled state as first state, and at least one fixed state as second state. In the enabled state, the fixing device enables the displaceability of the at least one bushing relative to the camshaft. In the fixed state, the fixing device suppresses the displaceability of the at least one bushing in the axial direction of the camshaft relative thereto.

In this case, the form-fitting element moves along the slide region upon a relative rotation between the sliding-block element and the at least one bushing, wherein, as a result of a switch-over of the fixing device from one of the states into the other state with form-fitting interaction with the slide region, the form-fitting element effects a displacement of the sliding-block element and hence the shift rod in the axial direction of the camshaft relative thereto.

This means that, in particular as a result of the switch-over of the fixing device upon a relative rotation between the sliding-block element and the bushing by means of the slide region, in particular by means of at least one slide track of the slide region, the form-fitting element is guided such that the relative rotation between the sliding-block element and the at least one bushing is converted by means of the slide region and by means of the form-fitting element into a displacement of the sliding-block element in the axial direction of the camshaft relative to the camshaft. As a result, the shift rod is displaced over the sliding-block element in the axial direction of the camshaft relative thereto, in order thereby to influence the actuation of the gas exchange valve. For example, the shift rod is connected to the sliding-block element, such that the shift rod is displaceable with the sliding-block element in the axial direction of the camshaft relative to the camshaft.

The form-fitting element may for example be configured as a pin or a ball, wherein the form-fitting element moves along the slide region if the sliding-block element is rotated relative to the at least one bushing. In this case, for example, the ball rolls along the slide region. In this case, the form-fitting element may for example interact in a form-fitting manner with the at least one bushing by the form-fitting element for example engaging in at least one recess, in particular raceway, of the at least one bushing. It is furthermore conceivable for the form-fitting element to interact with the at least one bushing, or is held or fixed thereon, in a form-fitting and/or materially cohesive and/or force-fitted manner.

Since the form-fitting element is provided or held on the at least one bushing and as a result is preferably secured against rotation about the axis of rotation, and since the form-fitting element engages in the slide region, the sliding-block element interacts in a form-fitting manner with the form-fitting element, with the form-fitting element for its part interacting with the at least one bushing in a form-fitting manner and/or otherwise being provided or held thereon, and as a result being secured for example against rotation about the axis of rotation. For example, the at least one bushing is also secured against rotation about the axis of rotation, such that the form-fitting element provided, in particular held, on the at least one bushing is held or guided in a defined manner. In this case, the at least one bushing is however displaceable with the form-fitting element in the axial direction or along the axis of rotation, in particular relative to the camshaft, in order thereby to effect an axial displacement of the sliding-block element. Thus, the sliding-block element interacts with the bushing via the form-fitting element in a form-fitting manner. If for example, the fixing device remains in the fixed state after its switch-over from the enabled state to the fixed state and thus after the axial displacement of the sliding-block element and hence of the shift rod effected thereby, an axial displacement of the sliding-block element and hence of the shift rod thus does not occur, in particular while the fixing device is held in its fixed state.

If, for example, there is then a switch-over of the fixing device from the previously set fixed state into the enabled state, such that the fixing device enables the axial displaceability of the at least one bushing, then for example, upon a relative rotation between the sliding-block element and the at least one bushing as a result of the switch-over of the fixing device from the fixed state into the enabled state, the form-fitting element effects a displacement of the sliding-block element and hence of the shift rod in the axial direction of the camshaft relative to the camshaft. Thus, it is for example possible to move the sliding-block element, and, via this, the shift rod, back and forth axially relative to the camshaft. A switch-over of the fixing device from the enabled state into the fixed state results for example in an axial displacement of the sliding-block element in a first direction that coincides with the axis of rotation of the camshaft. A switch-over of the fixing device from the fixed state into the enabled state results for example in an axial displacement of the sliding-block element in a second direction that coincides with the axis of rotation and that is opposed to the first direction, such that the sliding-block element and, via this, the shift rod, can be moved back and forth as needed in the axial direction of the camshaft relative thereto.

In this case, the valvetrain according to the invention enables particularly quick and precise switching times of the sliding-block element and hence the shift rod, in particular independently of electrical control, such that the actuation of the gas exchange valve can be particularly advantageously influenced. Furthermore, the use of precisely one actuator is sufficient in order to displace the sliding-block element and hence the shift rod both in the first direction and in the second direction. This precisely one actuator is for example the fixing device, which is configured for example as an electrical actuator, i.e., as an actuator that is operable or actuatable electrically. Thus, the number of parts, the weight, the installation space requirement and the costs of the valvetrain can be kept particularly low.

In the valve train according to the invention, the actuation of the gas exchange valve can be influenced in particular by the fact that, by axially displacing the shift rod relative to the camshaft, it is possible to switch over between an actuation of the gas exchange valve effected or effectable by a first cam and an actuation of the gas exchange valve effected or effectable by a second cam different from the first cam.

The first cam is for example configured as a firing cam, with the second cam for example being configured as what is referred to as a braking cam. If the gas exchange valve, for example configured as an exhaust valve, is actuated for example by means of the firing cam, a firing mode of the internal combustion engine is set. If however the gas exchange valve, configured as an exhaust valve, is actuated for example by means of the braking cam, then as a result for example an engine braking mode or an engine brake of the internal combustion engine is set. Thus, it is possible by means of the valvetrain according to the invention to switch over between the engine braking mode and the firing mode particularly quickly and at precise moments in time. In this case, the cams differ from one another in terms of their respective outer contours or cam profiles, such that the gas exchange valve can be actuated differently, i.e., in particular opened, by means of the cam.

It has proven particularly advantageous if the fixing device has at least one magnet, in particular an electromagnet, for providing magnetic forces, by means of which the displaceability of the at least one bushing in the fixed state is suppressed. This means that the magnet provides the magnetic forces at least in the fixed state, in order to suppress the axial displaceability of the at least one bushing by means of the magnetic forces. The use of a magnet, in particular of an electromagnet, makes it possible to switch the fixing device over particularly when needed and also quickly and precisely between the fixed state and the enabled state.

In a further configuration of the invention, a plurality of form-fitting elements, provided on the at least one bushing, is provided. As a result, particularly quick axial movement of the sliding-block element and hence the shift rod can be achieved. Furthermore, excess loads and hence load peaks can be avoided, such that particularly low-wear operation can be realised. The preceding and following embodiments regarding the at least one form-fitting element provided on the at least one bushing can be readily transferred to the other form-fitting element provided on the at least one bushing, and vice-versa.

A further embodiment is characterized in that at least one spring element is arranged in the camshaft, by means of which spring element the shift rod can be supported on the camshaft in the axial direction thereof. The spring element is in particular configured to provide an elastic force which acts in the axial direction of the camshaft, which can be braced on the camshaft on one side and on the shift rod in the axial direction of the camshaft on the other. By means of the elastic force, for example, the shift rod can be moved in the axial direction of the camshaft relative thereto and/or be held in at least one position, such that a particularly advantageous operation, in particular a particularly needs-based axial movement of the shift rod, can be achieved. The arrangement of the spring element in the camshaft further makes it possible to keep the installation space requirement of the valvetrain particularly low.

In a particularly advantageous embodiment of the invention, at least one spring is provided. Preferably, the spring and the spring element are configured as components that differ from one another. By means of the spring, the at least one bushing is displaceable in the direction of the fixing device, in the axial direction of the camshaft relative thereto.

By using the spring, for example, the number of active controlling elements or actuators can be kept particularly low, such that the costs, the weight, the number of parts and the installation space requirement of the valvetrain can be kept particularly low.

In a particularly advantageous configuration of the invention, at least one second bushing is provided, wherein a second length region of the sliding-block element rotatable about the axis of rotation relative to the bushings is accommodated in the second bushing. Moreover, at least one second form-fitting element is provided on the second bushing, which engages in a second slide region of the shift gate that is at least partially arranged in the second length region. The preceding and following embodiments regarding the first bushing and regarding the first form-fitting element can also be readily transferred to the second bushing and the second form-fitting element, and vice-versa. The use of the first and of the second form-fitting element and the use of the first slide region and of the second slide region enables particularly quick switching times to be achieved.

In this case, it has proven particularly advantageous if a plurality of form-fitting elements, provided on the second bushing, is provided, as a result of which excess loads can be avoided.

A further embodiment is characterized in that, in the enabled state, the at least one bushing is displaceable in the axial direction of the camshaft relative thereto, wherein, both in the enabled state and in the fixed state, the other bushing is fixed or secured in the axial direction of the camshaft relative thereto. While therefore the at least one bushing can execute desired movements relative to the camshaft in the axial direction of the camshaft in a targeted manner, such axial relative movements are not provided between the other bushing and the camshaft, as a result of which the complexity of the valvetrain is kept particularly low.

In order to effect a particularly quick displacement of the sliding-block element and hence the shift rod in the axial direction of the camshaft relative thereto, a further embodiment of the invention provides that, in the enabled state, both bushings are displaceable in the axial direction of the camshaft relative thereto.

In order to further be able to keep in particular the axial installation space requirement of the valvetrain particularly low, another embodiment provides for at least part of the fixing device to be arranged in the axial direction of the camshaft between the bushings.

Further advantages, features and details of the invention will become apparent from the following description of preferred exemplary embodiments and also using the drawings. The features and combinations of features mentioned above in the description, and also the following features and combinations of features mentioned in the description of the Figures and/or only shown in the Figures are not only applicable in the respectively stated combinations but also in other combinations or alone, without departing from the scope of the invention.

DETAILED DESCRIPTION OF THE DRAWINGS

Figure 1:
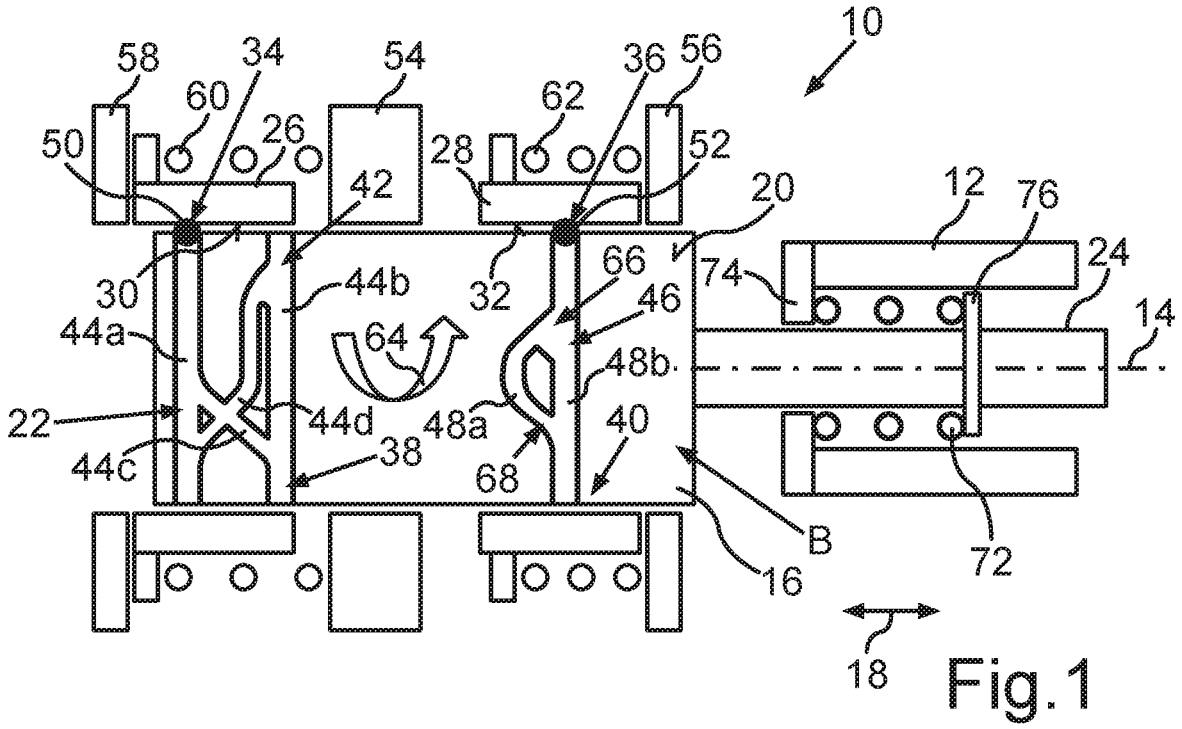
FIG. 1 is a section of a schematic depiction of a first embodiment of a valvetrain according to the invention, having at least one camshaft, having at least one shift rod at least partially accommodated in the camshaft, and having two bushings displaceable relative to one another and relative to the camshaft in the axial direction of the camshaft, by means of which an axial displacement of the shift rod relative to the camshaft can be effected.

Identical or functionally identical elements are provided with the same reference numerals in the Figures.

FIG. 1 shows a section of a schematic depiction of a first embodiment of a valvetrain 10 for an internal combustion engine of a motor vehicle, which is configured for example as a car, in particular as a commercial vehicle. In this case, the internal combustion engine is configured as a reciprocating piston engine or a reciprocating internal combustion engine and has at least one combustion chamber configured as a cylinder, for example. During a firing mode of the internal combustion engine, air and fuel, in particular liquid fuel, are supplied to the combustion chamber for the operation of the internal combustion engine. As a result, a fuel-air mixture is formed in the combustion chamber (cylinder), which is ignited. This results in exhaust gas from the internal combustion engine.

In this case, at least one exhaust port is associated with the cylinder, by means of which the exhaust gas can be discharged out of the cylinder. In this case, a gas exchange valve configured as an exhaust valve is associated with the exhaust port, which gas exchange valve can be moved, in particular translationally, between a closed position and at least one open position. In this case, the valve train 10—as will be described in more detail below—is used to actuate the gas exchange valve (exhaust valve), i.e., to move it out of the closed position into the open position. In the closed position, the exhaust valve fluidically blocks the associated exhaust port. On the contrary, in the open position the exhaust valve releases the exhaust port.

As will be described below in more detail, the cylinder or the internal combustion engine as a whole can be switched over between an engine braking mode and the firing mode. During the engine braking mode, no combustion processes take place in the cylinder. In the engine braking mode, engine braking of the internal combustion engine is activated, or the internal combustion engine acts as an engine brake, by means of which wheels of the motor vehicle, and hence the motor vehicle as a whole, can be slowed down.

In this case, it is possible to switch over between the engine braking mode and the firing mode by switching over between an actuation of the exhaust valve effected or effectable by means of a first cam and an actuation of the exhaust valve effected or effectable by means of a second cam different from the first cam. The first cam is for example a firing cam, with the second cam for example being a braking cam. If for example, the exhaust valve is actuated by means of the firing cam while the exhaust valve is not actuated by the braking cam, the firing mode is set. If, on the other hand, the exhaust valve is actuated by means of the braking cam while the exhaust valve is not actuated by the firing cam, the engine braking mode is thereby set. The means that during the firing mode the exhaust valve is actuated by means of the firing cam, while the exhaust valve is not actuated by the braking cam. During the engine braking mode, the exhaust valve is actuated by means of the braking cam, while the exhaust valve is not actuated by the firing cam.

The cams are for example arranged on a camshaft 12 of the valvetrain 10, which is visible in section in FIG. 1, and are arranged one after the other or next to one another in the axial direction of the camshaft 12. In this case, the camshaft 12 and hence the cams are arranged so as to rotate about an axis of rotation 14, in particular relative to a housing element of the internal combustion engine, since the cams are for example arranged on the camshaft 12 and are connected to the camshaft 12 in a rotationally fixed manner. The housing element is for example a cylinder head, wherein the camshaft 12 is mounted on the housing element so as to rotate about the axis of rotation 14 relative to the housing element. The above-described switch-over between the actuation of the exhaust valve effected by means of the firing cam and the actuation of the exhaust valve effected by means of the braking cam is for example sufficiently described in DE 10 2013 019 000 A1, the content of which is to be considered as entirely incorporated in the present disclosure.

The valvetrain 10 comprises a sliding-block element 16 which is connected in a rotationally fixed manner to the camshaft 12 and hence can be driven by the camshaft 12, such that the sliding-block element 16, for example upon rotation of the camshaft 12 about the axis of rotation 14, rotates along with the camshaft 12 about the axis of rotation 14. The sliding-block element 16 is however displaceable in the axial direction of the camshaft 12 relative to the camshaft 12. This axial displaceability of the sliding-block element 16 relative to the camshaft 12 is illustrated in FIG. 1 by an arrow 18. The sliding-block element 16 has an outer circumferential jacket surface 20 with at least one shift gate 22, by means of which a rotational movement of the sliding-block element 16 about the axis of rotation 14 can be converted into a displacement of the sliding-block element 16 in the axial direction of the camshaft 12 relative to the camshaft 12.

In addition, the valvetrain 10 further comprises a shift rod 24 at least partially, in particular at least predominantly, accommodated in the camshaft 12 and displaceable by means of the sliding-block element or via the sliding-block element 16 in the axial direction of the camshaft 12 relative to the camshaft 12, by means of which shift rod an actuation of the exhaust valve can be influenced. By axially displacing the shift rod 24 relative to the camshaft 12, it is possible to switch over between the actuation of the exhaust valve effected by the firing cams and the actuation of the exhaust valve effected by the braking cams, and hence between the engine braking mode and the firing mode. The shift rod 24 is for example, in particular at least indirectly, connected to the sliding-block element 16 and hence is displaceable with the sliding-block element 16 in the axial direction of the camshaft 12 relative thereto. If the sliding-block element 16 is displaced in the axial direction of the camshaft 12 relative to the camshaft 12, then the shift rod 24 is displaced along with the sliding-block element 16 in the axial direction of the camshaft 12 relative thereto. Thus, by axially displacing the sliding-block element 16 and the shift rod 24 relative to the camshaft 12, it is possible to switch over between the engine braking mode and the firing mode. As indicated above, the axial displacement of the sliding-block element 16 and hence the shift rod 24 relative to the camshaft 12 is effected by means of the slide track 22.

In order now to be able to effect a particularly advantageous operation of the valvetrain 10 and in particular to produce quick and precise switching times, the valvetrain 10 comprises two bushings 26 and 28 which each have at least one inner circumferential jacket surface 30 or 32 each with at least one recess 34 or 36, respectively. In this case, a first length region 38 of the sliding-block element 16 is accommodated in the bushing 26, with a second length region 40 of the sliding-block element 16 which follows the first length region 38 in the axial direction of the sliding-block element 16 being accommodated in the bushing 28. This means that the bushing 26 completely circumferentially surrounds the length region 38 of the sliding-block element 16 in the circumferential direction of the sliding-block element 16. Furthermore, the bushing 28 for example completely circumferentially surrounds the second length region 40 of the sliding-block element 16 in the circumferential direction of the sliding-block element 16. Furthermore, the sliding-block element 16 is rotatable about the axis of rotation 14 relative to the bushings 26 and 28. In the first embodiment of the valvetrain 10 illustrated in FIGS. 1 to 7, both bushings 26 and 28 are displaceable in the axial direction of the camshaft 12 relative to the camshaft 12 and relative to one another.

The shift gate 22 has a first slide region 42 arranged at least partially in the first length region 38, having a plurality of slide tracks 44*a-d*. The shift gate 22 further has a second slide region 46 arranged at least partially in the second length region 40, having a plurality of slide tracks 48*a,b*. A plurality, in particular three, first form-fitting elements in the form of balls 50 are associated with the slide region 42 and with the recess 34 associated with the slide region 42, which form-fitting elements engage both in the recess 34 of the bushing 26 and also in the slide region 42. Thus, the balls 50 are each partially accommodated in the recess 34 and in the slide region 42. In particular, each ball 50 is provided with a corresponding recess 34, such that the bushing 26 for example has a plurality of recesses 34.

A plurality, in particular three, second form-fitting elements in the form of balls 52 are associated with the slide region 46 and with the recess 36 associated with the slide region 46, which form-fitting elements engage both in the recess 36 and also in the slide region 46. Thus, the balls 52 are each partially accommodated in the recess 36 and in the slide region 46. In particular, each ball 52 is provided with a corresponding recess 36, such that the bushing 28 for example has a plurality of recesses 36. Thus, the sliding-block element 16 interacts in a form-fitting manner with the bushings 26 and 28 via the slide regions 42 and 46, the balls 50 and 52 and the recesses 34 and 36, in particular in the axial direction of the camshaft 24. The balls 50 and 52 are respective form-fitting elements, with it being possible to use other form-fitting elements different from balls, for example pins, as the form-fitting elements.

In this case, the bushings 26 and 28 are secured against rotation about the axis of rotation 14, in particular relative to the housing element, such that the bushings 26 and 28 are not able to rotate about the axis of rotation 14, in particular relative to the housing element. The balls 50 and 52 in this case are provided on the bushings 26 and 28 such that the balls 50 and 52 are secured against rotation about the axis of rotation 14, in particular relative to the bushings 26 and 28. Thus, the balls 50 and 52 (form-fitting elements) also cannot rotate about the axis of rotation 14 relative to the bushings 26 and 28 or relative to the housing element.

It is particularly clear to see from FIG. 1 that the slide regions 42 and 46 are spaced apart from one another in the axial direction of the sliding-block element 16, the axial direction of which coincides with the axial direction of the camshaft 24 and hence the axis of rotation 14. Furthermore, the slide regions 42 and 46 are separated from one another. The recesses 34 and 36 are also separated from one another. This separation should be understood to mean that, for example, while the balls 50 roll along the slide tracks 44*a-d* and hence along the slide region 42, and thereby can optionally rotate about themselves in the respective recess 34, the balls 50 cannot however roll from the respective recess 34 into the respective recess 36, nor from the slide region 42 into the slide region 46. The same applies for the balls 52. While the balls 52 roll along the slide region 46, i.e., along the slide tracks 48*a,b*, and optionally rotate about themselves in the respective recess 36, the balls 52 cannot however roll from the respective recess 36 into the respective recess 34, nor from the slide region 46 into the slide region 42. Since the balls 50 or 52 engage in the recess 34 or 36 and also in the slide region 42 or 46, the balls 50 or 52 are guided by means of the respective recess 34 or 36 and by means of the slide region 42 or 46. In particular, the balls 50 and 52 are secured against rotation about the axis of rotation 14, in particular relative to the housing element, by means of the respective recesses 34 and 36 and by means of the bushings 26 and 28.

As will be described in more detail below, it is possible by means of the shift gate 22, in particular by means of the slide regions 42 and 46, to convert a relative rotation between the sliding-block element 16 and the bushings 26 and 28 into an axial displacement of the sliding-block element 16 and hence of the shift rod 24 relative to the camshaft 12. Such a conversion of relative rotations into axial displacements by means of slide tracks is well known from the general prior art and in this case for example from DE 10 2013 019 000 A1, already mentioned above, and will only be briefly described below. In order to convert a relative rotation between the sliding-block element 16 and the bushings 26 and 28 into an axial displacement of the sliding-block element 16, the slide region 42 or 46 has at least one length region or partial region, which for example extends in a plane extending obliquely to the axis of rotation 14. In other words, the slide region 42 or 46 has at least one wall region, which extends in the abovementioned plane running obliquely to the axis of rotation 14, or a plane tangential to the wall region extends obliquely to the axis of rotation 14. In this case, for example, the abovementioned partial region or length region or the wall region extends in an at least essentially arcuate manner, in particular in the circumferential direction of the sliding-block element 16.

Through this configuration or through this course of the length region or partial region or of the wall region, for example the respective balls 50 or 52 come to a position supported against the wall region upon a relative rotation between the sliding-block element 16 and the respective bushing 26 or 28. This supported position results for example in a force that acts in the axial direction of the camshaft 12 and hence along the axis of rotation 14, by means of which force the sliding-block element 16 and hence the shift rod 24 can be displaced axially relative to the camshaft 12. For example, the slide tracks 44*c*, 44*d* and 48*a* have such wall regions extending in an arcuate manner or obliquely to the axis of rotation 14, against which the balls 50 or 52 can come to a supported position, in order thereby to generate a force, which acts in the axial direction and is the result of a torque acting on the sliding-block element 16 by means of which the sliding-block element 16 is rotated relative to the bushings 26 and 28, by means of which force the sliding-block element 16 can be displaced in the axial direction relative to the camshaft 12.

In this case, the bushings 26 and 28 are preferably fixed radially or in the circumferential direction of the camshaft 12, such that they preferably do not rotate along with the camshaft 12 or the sliding-block element 16. The form-fitting elements (balls 50 and 52) are also preferably fixed in the circumferential direction of the camshaft 12 or radially. As a result, regions or angular positions are defined or fixed, in which the respective switch-over or displacement of the sliding-block element 16 occurs.

By corresponding shaping or forming of the recesses 34 and 36, for example configured as raceways, and/or in particular of the slide tracks 44*a-d* and 48*a,b*, the time and the angular position, speed, acceleration and resultant forces of the respective switch-over or displacement can be set. The Figure depicts the slide tracks 44*a-d* and 48*a,b* together. It is alternatively conceivable for these to be separated, such that the intersections disappear. It is furthermore conceivable to affix a plurality of adjustment tracks at the circumference of the sliding-block element 16, in order thereby to be able to switch once or several times per rotation.

In this case, the valvetrain 10 moreover comprises a fixing device 54 which can be switched over between at least one enabled state and at least one fixed state. In the enabled state, the fixing device 54 enables the displaceability of at least one of the bushings 26 and 28, in particular the bushing 28, in the axial direction of the camshaft 12 relative thereto. It can in particular be provided that, in the enabled state of the fixing device 54, both bushings 26 and 28 can be displaced in the axial direction of the camshaft 12 relative thereto. In the fixed state, however, the displaceability of the at least one bushing 26 or 28 in the axial direction of the camshaft 12 relative thereto is suppressed by means of the fixing device 54. For example, in the fixed state, the fixing device 54 suppresses the axial displaceability of the bushing 28 and/or bushing 26 relative to the camshaft 12.

Upon a relative rotation between the sliding-block element 16 and the bushings 26 and 28, the balls 50 and 52 are for example moved along the slide regions 42 and 46 such that the balls 50 and 52 roll along the slide regions 42 and 46 which are for example configured as raceways. Furthermore, upon such a relative rotation of the sliding-block element 16 relative to the bushings 26 and 28 as a result of a switch-over of the fixing device 54 from the enabled state into the fixed state and in particular if the balls 50 or 52 come to a position supported against at least one of the abovementioned wall regions, the balls 50 and 52 effect a displacement of the sliding-block element 16 and hence of the shift rod 24 in the axial direction of the camshaft 12 relative thereto.

In the first embodiment, the valvetrain 10 comprises stops 56 and 58 and also springs 60 and 62. In this case, the spring 60 is braced on one side on the bushing 26 and on the other side on the fixing device 54 arranged in the axial direction of the camshaft 12 at least partially between the bushings 26 and 28. An axial movement of the bushing 26 away from the fixing device 54 is in particular restricted by means of the stop 58. The spring 62 is braced on one side on the bushing 28 and on the other side on the stop 56. An axial movement of the bushing 28 away from the stop 56 is for example restricted by means of the fixing device 54. The spring 62 provides for example an elastic force, which acts away from the stop 56 in the direction of the fixing device 54, the bushing 26 and/or the stop 58. The spring 60 provides for example an elastic force, which acts away from the fixing device 54 and for example from the bushing 28 and from the stop 56 in the direction of the stop 58. An arrow 64 in FIG. 1 further depicts a rotation of the sliding-block element 16 about the axis of rotation 14 relative to the bushings 26 and 28. For example, the shift rod 24 is connected in a rotationally fixed manner to the sliding-block element 16, such that the shift rod 24 rotates about the axis of rotation 14 along with the sliding-block element 16. The slide tracks 44*c* and 44*d* function for example as intersections, via which the balls 50 can roll from the slide track 44*a* into the slide track 44*b* or conversely from the slide track 44*b* into the slide track 44*a*.

FIG. 1 shows for example a first position of the sliding-block element 16 and the shift rod 24. This first position is also designated firing position, since the firing mode is set in the first position. Thus, the exhaust valve is actuated by means of the firing cam in the firing position.

The fixing device 54 comprises for example at least one electromagnet or is configured as an electromagnet, with the electromagnet being in particular able to be configured as an electrical ring magnet. The electromagnet is deactivated in the enabled state, such that the electromagnet does not provide any magnetic forces. In order to transfer the fixing device 54 from the enabled stated into the fixed state, the electromagnet is activated, such that the electromagnet then provides magnetic forces. The magnetic forces can in particular interact with the bushing 28 and also optionally with the bushing 26, such that the bushings 26 and 28 can be secured by means of the magnetic forces against an axial displacement relative to the camshaft 12.

A region B is furthermore depicted in FIG. 1. The region B is for example an adjustment region, in which an axial displacement of the sliding-block element 16 and hence of the shift rod 24 relative to the camshaft 12 can be effected or is effected. For example, the region B extends in the circumferential direction of the sliding-block element 16 over 45 degrees, in particular about the axis of rotation 14. In this case, the circumferential direction of the sliding-block element 16 coincides with a direction of rotation in which the sliding-block element 16 and hence the camshaft 12 are rotated about the axis of rotation 14 during operation of the internal combustion engine or of the valvetrain 10.

If the sliding-block element 16 is rotated in the direction of rotation relative to the bushings 26 and 28, the balls 52 for example first roll along the slide track 48*b*. If the balls 52 then for example reach an entry 66 of the slide track 48*a*, the balls 52 are moved, in particular pushed, via the bushing 28, by means of the spring 62 or by means of the elastic force provided by the spring 62, from the slide track 48*b* into the slide track 48*a*. In this case, the bushing 28 is moved, in particular pushed, away from the stop 56 in the direction of the fixing device 54 and in particular into a position supported against the fixing device 54.

Upon further rotation of the sliding-block element 16, the balls 52 then roll along the slide track 48*a* and in particular to an exit 68 of the slide track 48*a*. On account of the above-described essentially arcuate course of the slide track 48*a*, the balls 52 are guided by means of the slide track 48*a* again in the direction of, or back towards, the slide track 48*b*. As a result, in the enabled state of the fixing device 54, the bushing 28 is moved away again, in particular pushed away again, by means of the slide track 48*a*, from the fixing device 54 back in the direction of the stop 56, in particular until the bushing 28 comes to a position supported against the stop 56. The spring 62 is tensioned thereby. Upon the movement from the slide track 48*b* into the slide track 48*a*, the bushing 28 is moved axially relative to the sliding-block element 16 in the direction of the fixing device 54. Upon the movement of the balls 52 from the slide track 48*a* into the slide track 48*b*, the bushing 28 is moved axially relative to the sliding-block element 16 away from the fixing device 54 in the direction of the stop 56. Thus, in the enabled state, while the fixing device 54 moves the bushing 28 back and forth in the axial direction relative to the sliding-block element 16 and relative to the camshaft 12, an axial displacement of the sliding-block element 16 in the shift rod 24 relative to the camshaft 12 does not however occur. In this case, the elastic force provided by the spring 60 is braced for example by means of the stop 58 and/or by means of the slide track 44*a*, such that the balls 50 remain in the at least essentially straight slide track 44*a* and roll along same.

Figure 2:
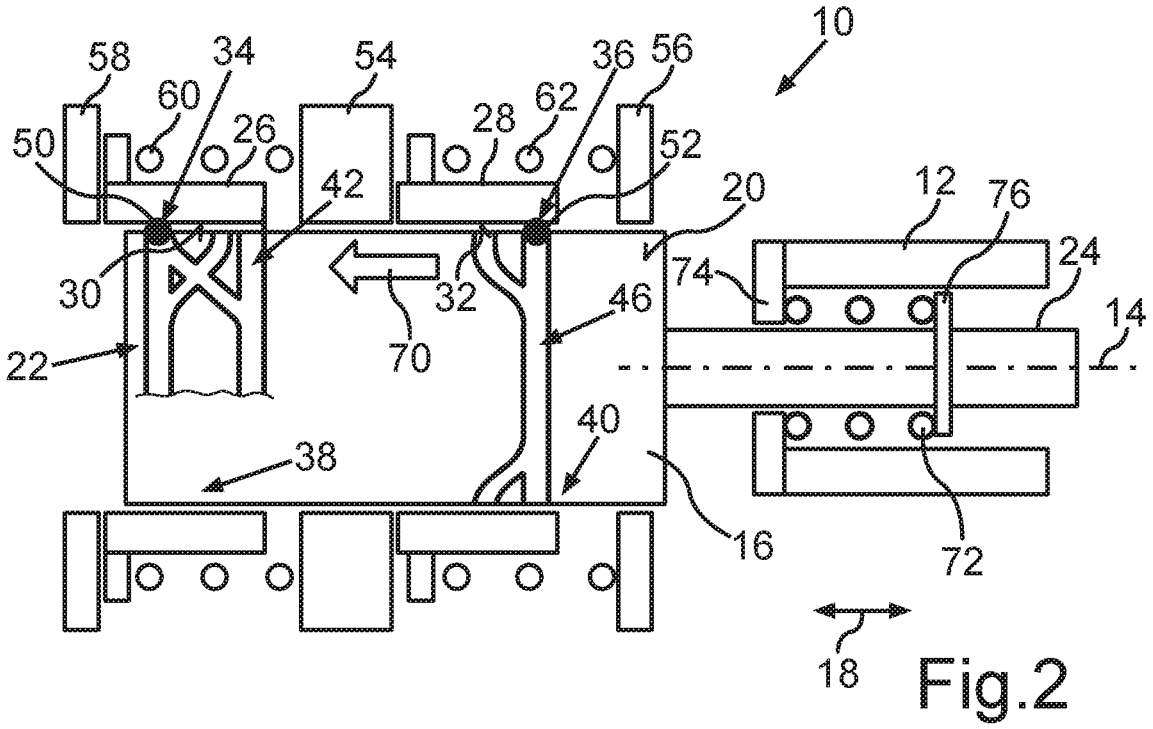
FIG. 2 is a section of a further schematic depiction of the valvetrain according to the first embodiment.
Figure 3:
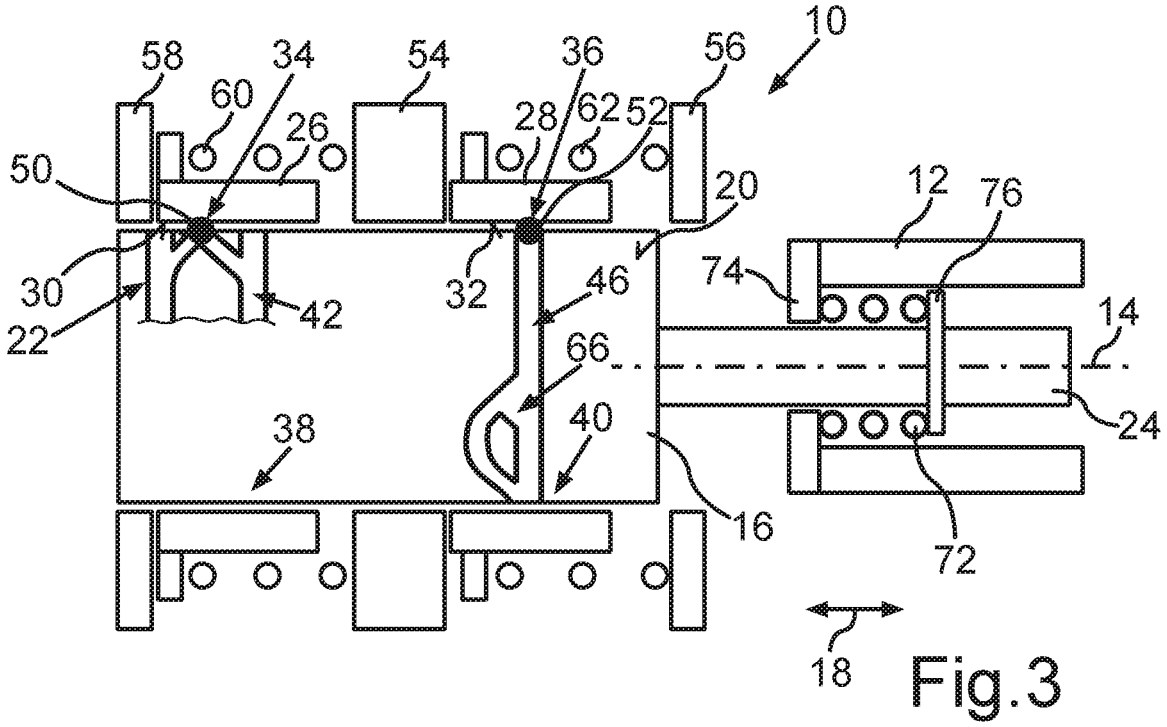
FIG. 3 is a section of a further schematic depiction of the valvetrain according to the first embodiment.

FIG. 2 now depicts a switch-over from the firing mode into the engine braking mode. In order to switch over from the firing mode into the engine braking mode, the sliding block element 16 and hence the shift rod 24 are displaced axially relative to the camshaft 12 out of the firing position into a braking position, for example shown in FIG. 4. In the braking position, the gas exchange valve is actuated by means of the braking cam, while actuation of the exhaust valve effected by the firing cam does not occur.

In order to move the sliding-block element 16 and hence the shift rod 24 out of the firing position into the braking position, the fixing device 54 or the electromagnet is activated and thus transferred from the enabled state into the fixed state. The electromagnet is for example activated by the electromagnet being energized. This should be understood to mean that the electromagnet is supplied with electrical current. In the enabled state, for example, the electromagnet is not energized.

In FIG. 2, an arrow 70 illustrates particularly well that the balls 52 are pushed via the bushing 28, by means of the elastic force provided by the spring 60, from the slide track 48*b* via the entry 66 into the slide track 48*a*, which is accompanied by an axial movement of the bushing 28 in the direction of, or into a supported position against, the fixing device 54. Thus, for example, the bushing 28 is displaced from a first position, shown in FIG. 1, into a second position, shown in FIG. 2. The activation of the electromagnet enables it to provide magnetic forces, by means of which the bushing 28 is held in the second position. In particular, the bushing 28 is held in a supported position against the fixing device 54 by means of the magnetic forces. Thus, upon further rotation of the sliding-block element 16, with the balls 52 rolling along the slide track 48*a* and in particular in the direction of the exit 68, it is not that the bushing 28 is moved away again from the fixing device 54, out of the second position into the first position, but rather that the sliding-block element 16, and with this the shift rod 24, are displaced in the axial direction of the camshaft 12 relative thereto in such a way that the sliding-block element 16 is displaced relative to the camshaft 12 and in particular in the direction of the camshaft 12. As a result, the sliding-block element 16 and the shift rod 24 are moved into the braking position. As can be seen particularly well from the combined viewing of FIGS. 2 and 3, this is enabled, or accompanied, by the balls 50 being moved from the slide track 44*a* into the slide track 44*c*, which functions as an intersection, and being moved by means of the slide track 44*c* to, and in particular into, the slide track 44*b*. It can furthermore be seen particularly well from FIGS. 2 to 4 that the bushing 26 is moved away from the stop 58, in the direction of the fixing device 54 and in particular into a position supported against the fixing device 54, by means of the slide track 44*c* via the balls 50 in the axial direction of the camshaft 12 relative thereto. Thus, the bushing 26 is moved from a third position, shown in FIG. 1, into a fourth position, shown in FIG. 4. For example, the bushing 26 is held in the fourth position by means of the fixing device 54, in particular by means of the magnetic forces, such that the balls 52 are then located in the at least essentially straight slide track 48*b* and the balls 50 are then located in the at least essentially straight slide track 44*b*. The at least essentially straight slide track 48*b* or 44*b* should be understood to mean that for example the respective slide track 48*b* or 44*b* is configured to be ring-like or annular in the circumferential direction of the sliding-block element 16 and to completely surround the sliding-block element, and therefore has no wall regions as described above which generate forces acting in the axial direction as a result of the relative rotation between the sliding-block element 16 and the bushings 26 and 28, by means of which forces the sliding-block element 16 could be displaced in the axial direction. Thus, the sliding-block element 16 and the shift rod 24 remain in the braking position shown in FIG. 4, in particular as long as the fixing device 54 is in the fixed state, i.e., in particular as long as the electromagnet is energized. Upon a relative rotation of the sliding-block element 16 relative to the bushings 26 and 28, the balls 50 and 52 then simply roll into the respective recesses 34 and 36 and into, and thereby along, the slide tracks 44*b* and 48*b*, without causing any axial displacement of the sliding-block element 16 or of the shift rod 24. As a result, the engine braking mode is maintained in particular as long as the fixing device 54 is in the fixed state.

In this case, the valvetrain 10 comprises a spring element 72 arranged in the camshaft 12, which spring element is braced in the axial direction of the camshaft 12 on one side on the camshaft 12, in particular on a collar 74 of the camshaft 12, and on the other side on the shift rod 24, in particular on a collar 76 of the shift rod 24. To this end, the spring element 72 is for example configured to at least temporarily provide an elastic force, in particular a compressive force, by means of which the shift rod 24 can be held in a desired position in particular in the region of the intersections. As a result, defined guidance for example of the ball 50, in particular in the region of the intersections, can be ensured. A switch-over from the engine braking mode back into the firing mode is described below using FIGS. 5 to 7. To this end, the sliding-block element 16 and the shift rod 24 are moved out of the braking position back into the firing position, i.e., displaced in the axial direction of the camshaft 12 relative thereto.

In order to switch over from the engine braking mode into the firing mode, the fixing device 54 is transferred from its fixed state into its enabled state. In terms of the first embodiment, this means that the electromagnet is deactivated. In other words, the energization of the electromagnet is ended, such that the electromagnet no longer provides magnetic forces. By moving the bushing 26 out of the third position into the fourth position, the spring 60 is tensioned and provides the abovementioned elastic force, which acts in the direction of the stop 58 and hence away from the fixing device 54. While the fixing device 54 is in its fixed state, the bushing 26 is held in the fourth position, counter to the elastic force provided by the spring 60. As a result, the balls 50 are held in the at least essentially straight slide track 44*b*. If however the fixing device 54 is now switched over from its fixed state into its enabled state, then the balls 50—as can be seen particularly well from FIGS. 5 and 6—are moved via the bushing 26 by means of the elastic force provided by the spring 60, from the slide track 44*b* into the slide track 44*d*. Furthermore, the balls 50 are guided to the slide track 44*a* and into the slide track 44*a* by means of the slide track 44*d* functioning as an intersection. This is accompanied by an axial displacement of the bushing 26 relative to the camshaft 12 out of the fourth position and back into the third position. Furthermore, by means of the slide track 44*d*, an axial displacement of the sliding-block element 16 relative to the camshaft 12 is effected, illustrated by an arrow 78 in FIG. 6, as a result of which the fixing device 54 is allowed or permitted to be in its enabled state. As a result, the sliding-block element 16 can take the bushing 28 with it, via the balls 52, and be displaced in the direction of the camshaft 12, with the bushing 28 being able to be displaced axially away from the fixing device 54 in the direction of the camshaft 12. As a result, the bushing 28 is displaced out of the second position back into the first position, such that the sliding-block element 16 and the shift rod 24 are in the firing position again.

Overall, it can be seen that, upon a relative rotation between the sliding-block element 16 and the bushings 26 and 28, with form-fitting interaction with the slide region 46 as a result of a switch-over of the fixing device 54 from the enabled state into the fixed state, the balls 52 effect a displacement of the sliding-block element 16 and the shift rod 24 out of the firing position into the braking position in a first displacement direction relative to the camshaft 12. Upon a relative rotation between the sliding-block element 16 and the bushings 26 and 28, with form-fitting interaction with the slide region 42 as a result of a switch-over of the fixing device 54 from the fixed state into the enabled state, the balls 50 effect an axial displacement of the sliding-block element 16 and the shift rod 24 relative to the camshaft 12 in a second displacement direction opposite to the first displacement direction. By the displacement of the sliding-block element 16 and the shift rod 24 in the first displacement direction, the sliding-block element 16 and the shift rod 24 are moved, in particular displaced, out of the firing position into the braking position.

As a result of the displacement of the sliding-block element 16 and the shift rod 24 in the second displacement direction, the sliding-block element 16 and the shift rod 24 are moved, in particular displaced, out of the braking position back into the firing position. This makes it possible to switch over between the engine braking mode and the firing mode particularly as needed and in a targeted manner. Upon the displacement in the first displacement direction, the sliding-block element 16 is braced on the fixing device 54 or held on the fixing device 54, via the slide region 46, in particular via the slide track 48*a*, the balls 52 and the bushing 28, such that it is not that the bushing 28 moves out of the second position into the first position, but rather that the sliding-block element 16 and the shift rod 24 are moved out of the firing position into the braking position. Upon the displacement in the second displacement direction, the sliding-block element 16 is braced on the stop 58, which is fixed relative to the camshaft 12 in the axial direction thereof, via the slide region 42, in particular via the slide track 44*d*, the balls 52 and the bushing 26, such that it is not that the bushing 26 is moved further away from the fixing device 54 starting from the third position, but rather that the sliding-block element 16 and the shift rod 24 are displaced in the second displacement direction and hence into the firing position.

Figure 4:
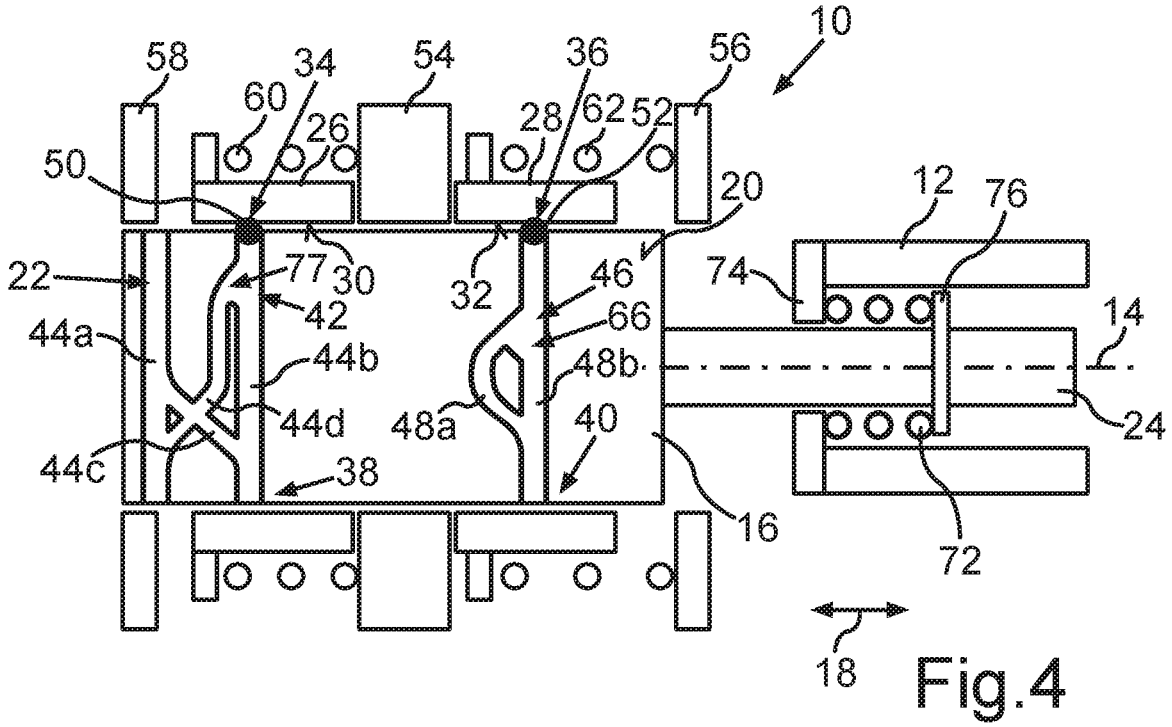
FIG. 4 is a section of a further schematic depiction of the valvetrain according to the first embodiment.
Figure 5:
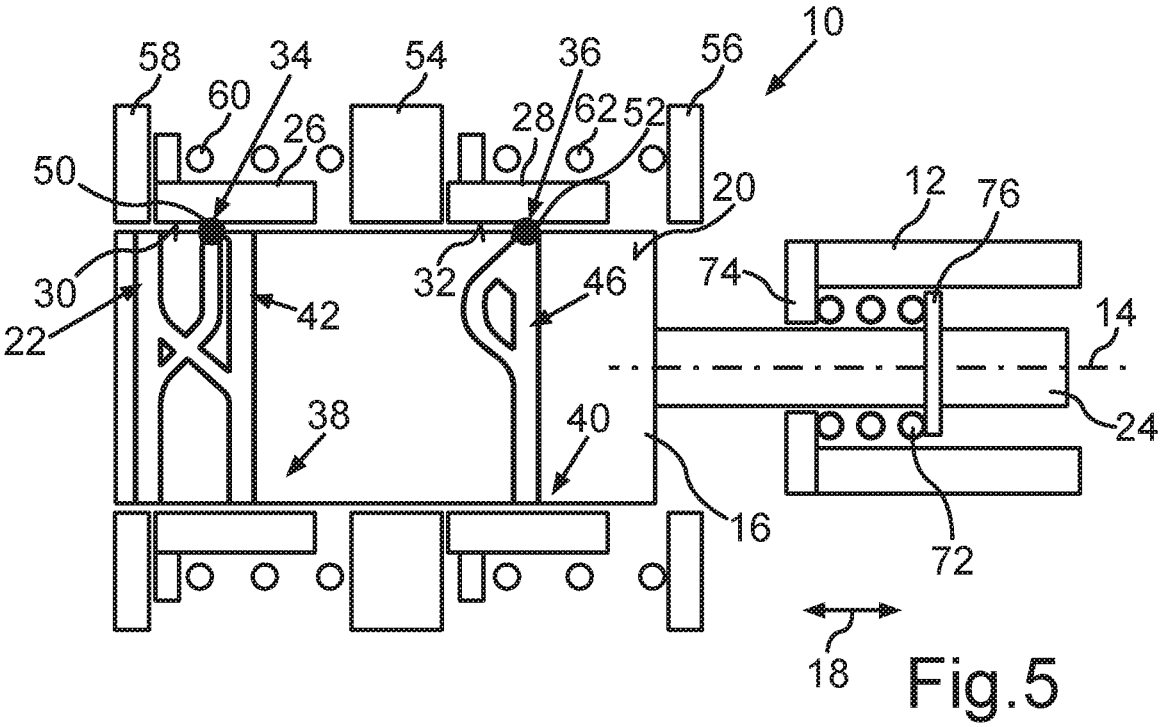
FIG. 5 is a section of a further schematic depiction of the valvetrain according to the first embodiment.
Figure 6:
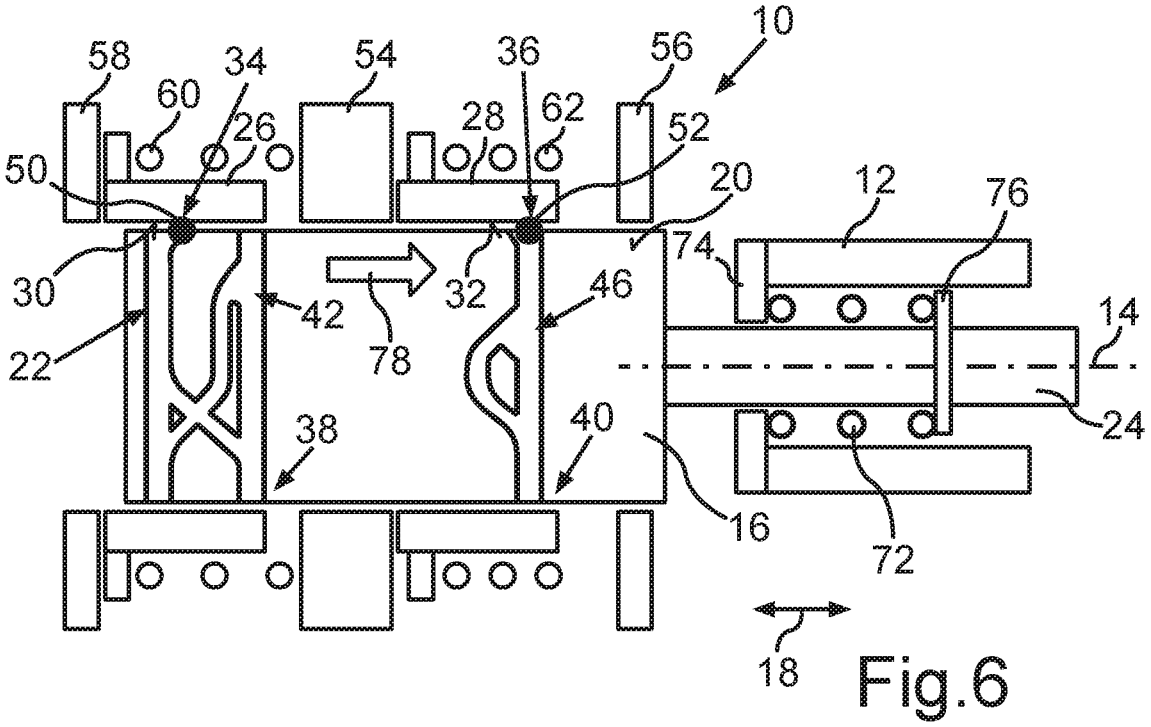
FIG. 6 is a section of a further schematic depiction of the valvetrain according to the first embodiment.
Figure 7:
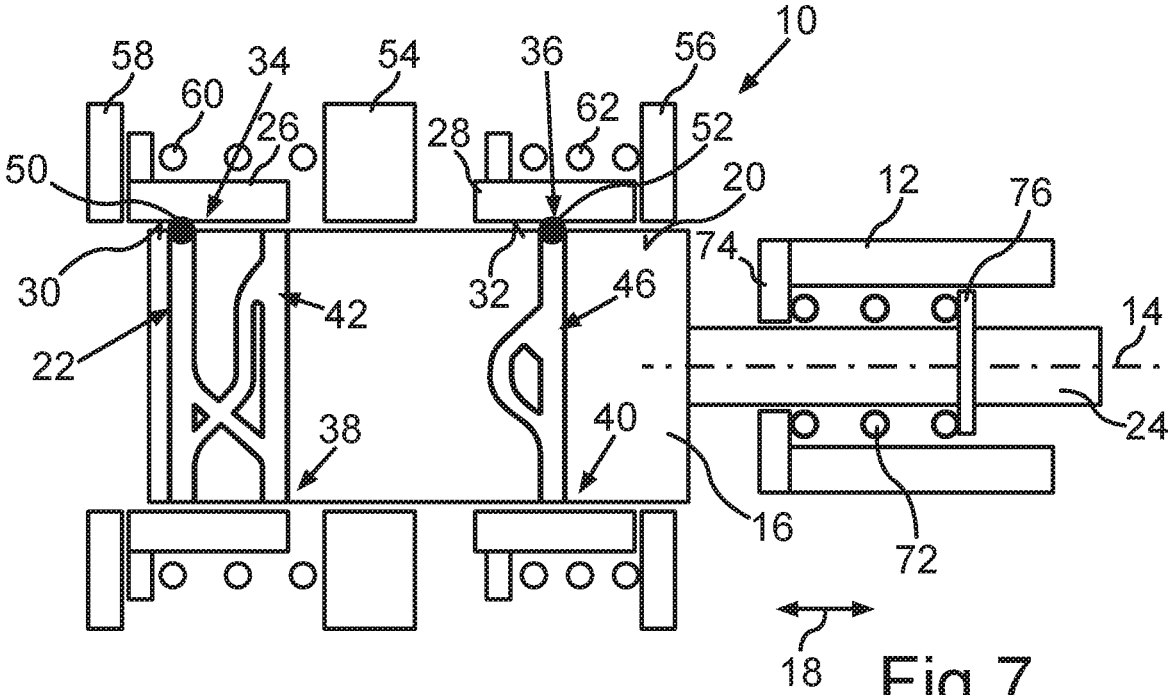
FIG. 7 is a section of a further schematic depiction of the valvetrain according to the first embodiment.

It can be seen particularly well from FIG. 4 that an entry 77 of the slide track 44*d* is arranged offset relative to the entry 66 of the slide track 48*a* in the circumferential direction of the sliding-block element 16 or in the direction of rotation. In this case, the balls 50 can roll via the entry 77 from the slide track 44*b* into the slide track 44*d*.

Figure 8:
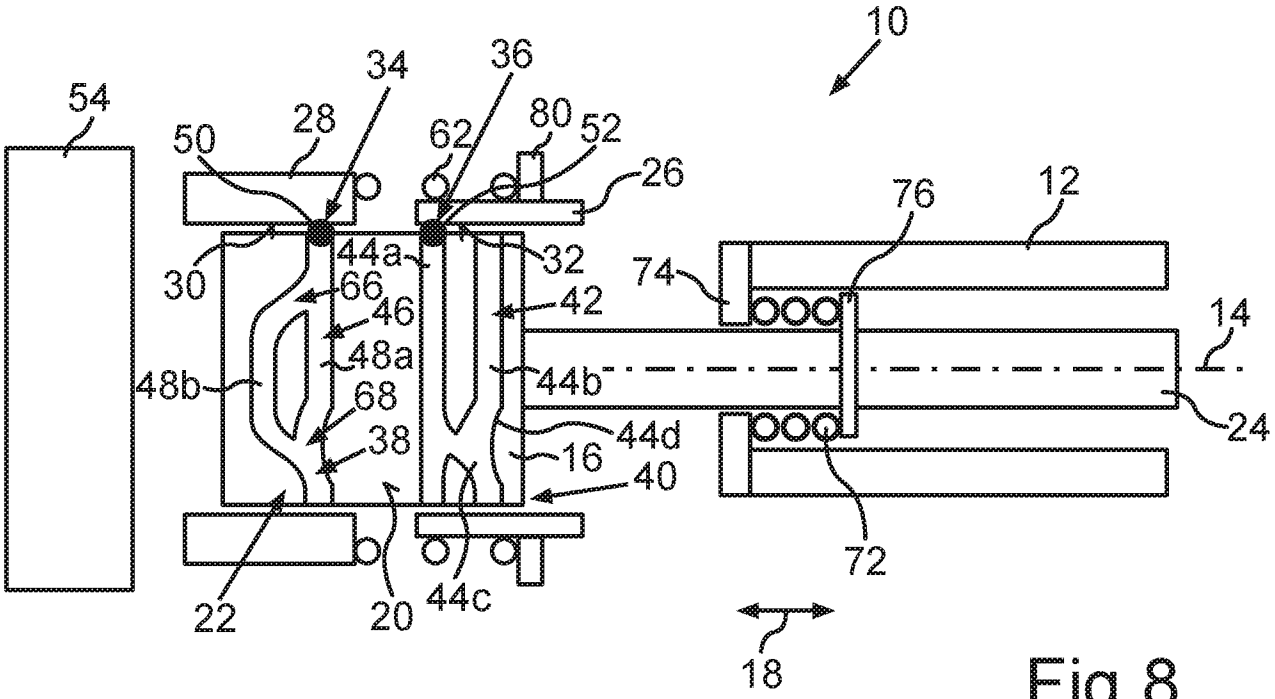
FIG. 8 is a section of a schematic depiction of a second embodiment of the valvetrain.

FIG. 8 shows a second embodiment of the valvetrain 10. In the second embodiment, the bushing 26 is fixed in the axial direction of the camshaft 12 relative thereto, and thus cannot be displaced, such that in terms of the bushings 26 and 28, only the bushing 26 is displaceable in the axial direction of the camshaft 12 relative thereto. In this case, the spring 62 is at least indirectly braceable or braced in the axial direction of the camshaft 12 on one side on the bushing 26, in particular on a collar 80 of the bushing 26, and on the other side on the bushing 28. As already explained regarding the first embodiment, upon a relative rotation between the sliding-block element 16 and the bushing 28, the bushing 28 is moved back and forth in the axial direction of the camshaft 12 relative thereto, if the fixing device 54 is in its enabled state.

If the bushing 28 is held in its first position by means of the fixing device 54, then, as described above, a displacement of the sliding-block element 16 and the shift rod 24 in the axial direction of the camshaft 12 relative thereto, out of the firing position into the braking position, is effected by means of the slide track 48*b*. In this case, the balls 50 pass from the slide track 44*a* via the slide track 44*c* into the slide track 44*b*. Furthermore, the spring element 72 is tensioned, in particular compressed. As a result of this, the spring element 72 provides an elastic force, against which the sliding-block element 16 and the shift rod 24 are held in the braking position by means of the fixing device 54.

If the fixing device 54 is then transferred into its enabled state, the spring element 72 can be at least partially relaxed, and as a result the sliding-block element 16 and the shift rod 24 are moved out of the braking position into the firing position. The balls 50 can then roll from the slide track 44*b* via the slide track 44*d* into the slide track 44*a*. This is possible because the fixing device 54 releases the bushing 28, which can thus be moved away from the fixing device 54 in the axial direction of the camshaft 12 relative thereto. As a result, the spring 62 is tensioned, as a result of which the spring 62 provides an elastic force, by means of which the bushing 28 can be moved in the direction of the fixing device 54.

In the second embodiment, the spring element 72 thus functions as a return spring, in order to move the shift rod 24 and the sliding-block element 16 from the braking position back into the firing position. In the first embodiment, the function of the spring element 72 as return spring is not required and not provided.

Figure 9:
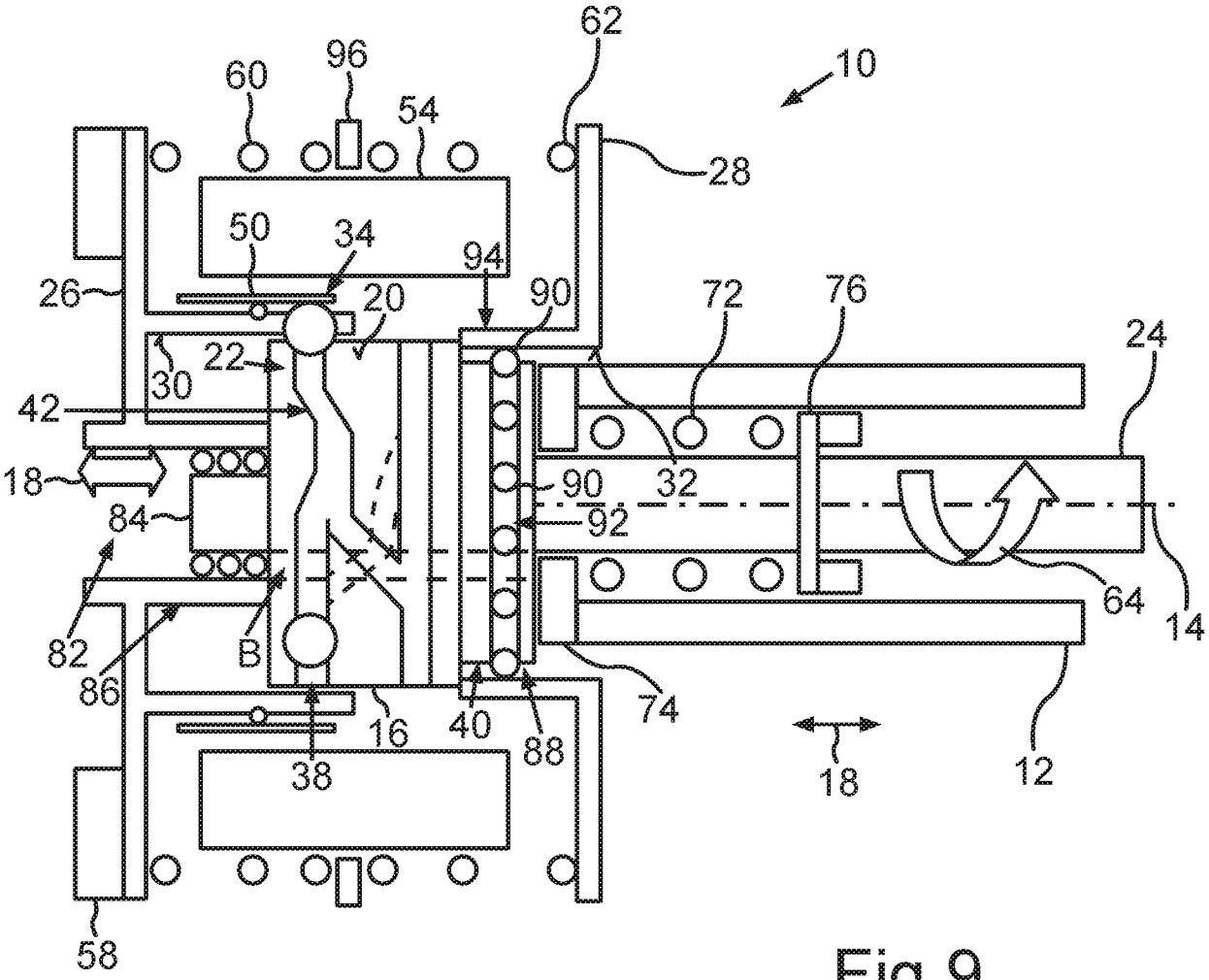
FIG. 9 is a section of a schematic depiction of a third embodiment of the valvetrain.
Figure 10:
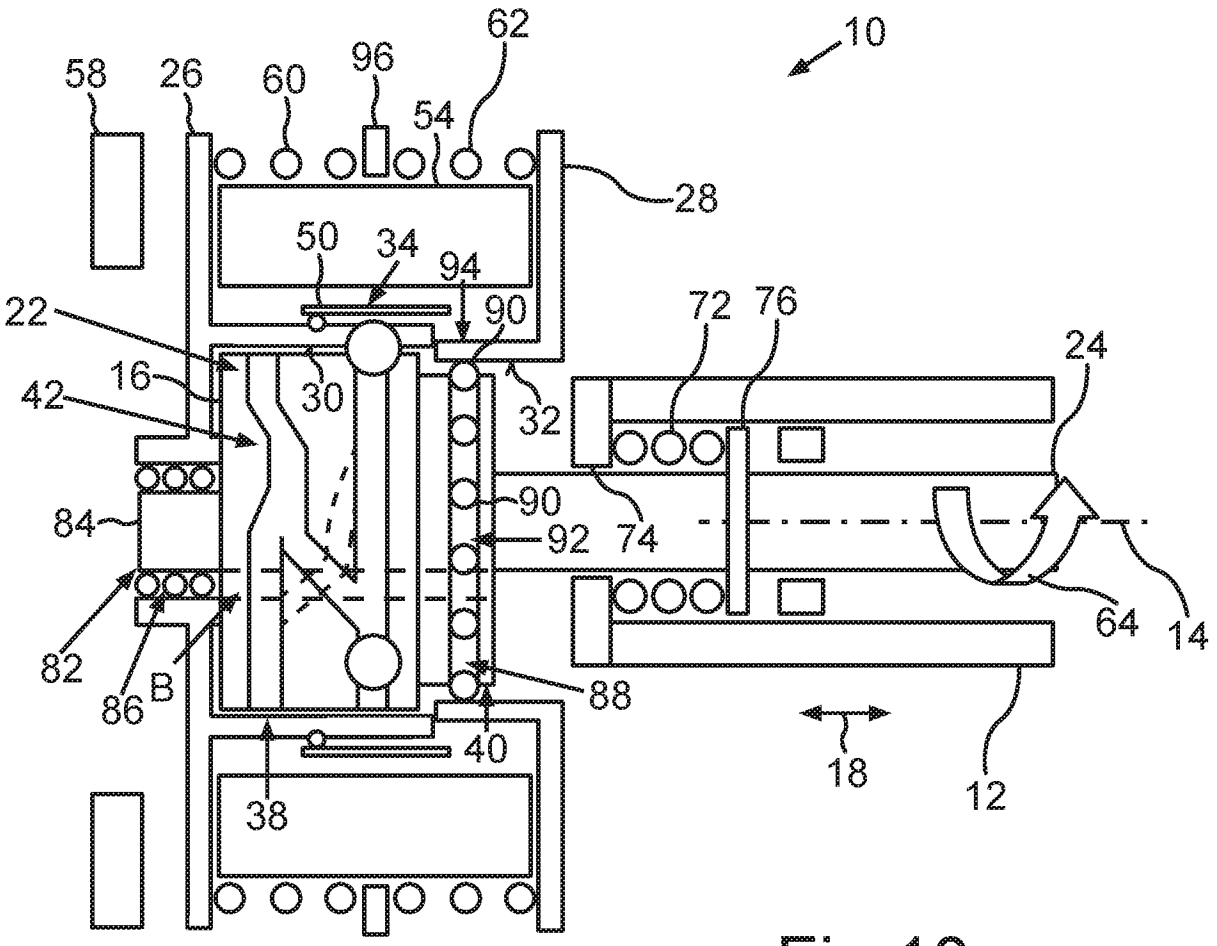
FIG. 10 is a section of a schematic depiction of the third embodiment of the valvetrain.

FIGS. 9 and 10 show a third embodiment of the valvetrain 10. In this case, FIG. 9 shows the shift rod 24 in the firing position, while FIG. 10 shows the shift rod 24 in the braking position. In the third embodiment, the fixing device 54 comprises for example a ring magnet, or is configured as a ring magnet, which is for example configured as an electromagnet. In addition, the bushing 26 has a bearing seat 82, for example configured as a through-opening, in which a bearing journal 84 of the sliding-block element 16 engages. In this case, the bushing 26 and the sliding-block element 16 bear against one another via the bearing seat 82, the bearing journal 84 and a bearing element 86 configured, for example, as a roller bearing, in particular as a ball bearing, in particular in the radial direction of the sliding-block element 16 or of the camshaft 12. In this case, the bearing element 86 is arranged for example in the radial direction of the bearing journal 84 between the bearing journal and a wall of the bushing 26 that at least partially delimits the bearing seat 82.

In addition, it is preferably provided for the balls 50 and/or 52 (form-fitting elements) to be arranged spread out in the circumferential direction of the sliding-block element 16 over the circumference thereof, such that for example if three form-fitting elements are provided, these are spaced apart from one another in pairs by 120 degrees in the circumferential direction of the sliding-block element over the circumference thereof.

In addition, in the third embodiment, in particular instead of the slide region 46 and instead of the balls 52, for example a conventional roller bearing 88 is provided, which is for example configured as a ball bearing. The bushing 28 and the sliding-block element 16 bear against one another via the roller bearing 88, in particular in the radial direction of the sliding-block element 16. In this case, the roller bearing comprises for example rolling elements 90 which are configured as the balls 52 or can be provided instead of the balls 52. The roller bearing 88 comprises for example an inner raceway 92, which is for example provided instead of the slide region 46 or is formed by the slide region, with the raceway 92 for example being formed directly by the sliding-block element 16 or the jacket surface 30 thereof. The rolling elements 90 engage in this case in the raceway 92. Thus, for example, the sliding-block element 16 functions as inner bearing ring of the roller bearing 88. In addition, the roller bearing 88 comprises an outer raceway 94, which is for example provided instead of the respective recess 36 or is formed by same, with the raceway 94 for example being formed directly by the bushing 28, in particular by the jacket surface 32 thereof. The rolling elements 90 engage in this case in the raceway 94. In this case, the bushing 28 functions for example as outer bearing ring of the roller bearing 88. If for example the sliding-block element 16 is rotated relative to the bushing 28, then for example the rolling elements 90 roll off to the respective raceways 92 and 94.

Furthermore, a stop 96 is arranged in the axial direction of the sliding-block element 16 or of the bushings 26 and 28 between the springs 60 and 62, on which stop the springs 60 and 62, which are supported on one side on the respective bushing 26 or 28, are braced on the other side. In addition, the third embodiment provides for the bushings 26 and 28 to each be partially arranged in the radial direction between the sliding-block element 16 and the fixing device 54.

In the third embodiment, for example the above-described displacement of the sliding-block element 16 and hence the shift rod 24 is merely effected by means of the bushing 26, the balls 50 and the slide region 42, with the displacement of the bushing 26 in the axial direction between the stop 58 and the fixing device 54 resulting in a displacement of the bushing 28 in the axial direction, since the bushing 28 is taken along by the sliding-block element 16 via the roller bearing 88, if the displacement thereof is effected by means of the bushing 26, the slide region 42 and the balls 50 in the described manner.

The invention claimed is:

1. A valvetrain (10) of an internal combustion engine, comprising:

a camshaft (12) rotatable about an axis of rotation (14);

a sliding-block element (16) connected in a rotationally fixed manner to the camshaft (12) and displaceable in an axial direction of the camshaft (12) relative to the camshaft, wherein the sliding-block element has an outer circumferential jacket surface (20) with a shift gate (22) via which a rotational movement of the sliding-block element (16) is convertible into a displacement of the sliding-block element (16) in the axial direction of the camshaft relative to the camshaft;

a shift rod (24) at least partially accommodated in the camshaft (12) and displaceable via the sliding-block element (16) in the axial direction of the camshaft (12) relative to the camshaft, wherein an actuation of a gas exchange valve is influenceable by the shift rod;

a bushing (26), wherein a length region (38) of the sliding-block element (16) rotatable about the axis of rotation (14) relative to the bushing (26) is accommodated in the bushing (26) and wherein the bushing (26) is displaceable in the axial direction of the camshaft (12) relative to the camshaft;

a form-fitting element (50) disposed on the bushing (26) and engaging in a slide region (42) of the shift gate (22) which is at least partially arranged in the length region (38); and a fixing device (54) which is switchable between an enabled state as a first state in which the fixing device (54) enables the displaceability of the bushing (26) relative to the camshaft (12) and a fixed state as a second state in which the displaceability of the bushing (26) in the axial direction of the camshaft (12) relative to the camshaft is suppressed by the fixing device (54);

wherein the form-fitting element (50) moves along the slide region (42) upon a relative rotation between the sliding-block element (16) and the bushing (26) and, as a result of a switch-over of the fixing device (54) from one of the first and second states into the other of the first and second states with form-fitting interaction with the slide region (42), effects a displacement of the sliding-block element (16) in the axial direction of the camshaft (12) relative to the camshaft.

2. The valvetrain (10) according to claim 1, wherein the fixing device (54) has a magnet for providing a magnetic force via which the displaceability of the bushing (26) in the fixed state is suppressed.

3. The valvetrain (10) according to claim 1 further comprising a plurality of form-fitting elements (50, 52).

4. The valvetrain (10) according to claim 1 further comprising a spring element (72) disposed in the camshaft (12) via which the shift rod (24) is braceable on the camshaft (12) in the axial direction of the camshaft (12).

5. The valvetrain (10) according to claim 1 further comprising a spring (60) via which the bushing (26) is displaceable in the axial direction of the camshaft (12) relative to the camshaft in a direction of the fixing device (54).

6. The valvetrain (10) according to claim 1 further comprising:

a second bushing (28), wherein a second length region (40) of the sliding-block element (16) rotatable about the axis of rotation (14) relative to the first and second bushings (26, 28) is accommodated in the second bushing (28); and a second form-fitting element (52) which is disposed on the second bushing (28) and engages in a second slide region (46) of the shift gate (22) that is at least partially disposed in the second length region (40).

7. The valvetrain (10) according to claim 6 further comprising a plurality of second form-fitting elements (52).

8. The valvetrain (10) according to claim 6, wherein, in the enabled state, one of the bushings (26, 28) is displaceable in the axial direction of the camshaft (12) relative to the camshaft and wherein, both in the enabled state and in the fixed state, the other of the bushings (26, 28) is fixed in the axial direction of the camshaft (12) relative to the camshaft.

9. The valvetrain (10) according to claim 6, wherein in the enabled state both of the bushings (26, 28) are displaceable in the axial direction of the camshaft (12) relative to the camshaft.

10. The valvetrain (10) according to claim 6, wherein at least a part of the fixing device (54) is disposed in the axial direction of the camshaft (12) between the bushings (26, 28).

* * * * *